US011501889B2

(12) United States Patent
Soldatov et al.

(10) Patent No.: US 11,501,889 B2
(45) Date of Patent: Nov. 15, 2022

(54) METHOD OF TREATMENT OF SPENT ION-EXCHANGE RESINS FOR DISPOSAL AND DEVICE FOR ITS IMPLEMENTATION

(71) Applicants: Joint Stock Company "Rosenergoatom", Moscow (RU); Joint Stock Company "Science and Innovations", Moscow (RU)

(72) Inventors: Mikhail Aleksandrovich Soldatov, g. Novovoronezh (RU); Mikhail Alekseevich Neupokoev, g. Novovoronezh (RU)

(73) Assignees: Joint Stock Company "Rosenergoatom", Moscow (RU); Joint Stock Company "Science and Innovations", Moscow (RU)

( * ) Notice: Subject to any disclaimer, the term of this patent is extended or adjusted under 35 U.S.C. 154(b) by 0 days.

(21) Appl. No.: 16/627,743

(22) PCT Filed: Sep. 13, 2018

(86) PCT No.: PCT/RU2018/000603
§ 371 (c)(1),
(2) Date: Dec. 30, 2019

(87) PCT Pub. No.: WO2020/013727
PCT Pub. Date: Jan. 16, 2020

(65) Prior Publication Data

US 2021/0335514 A1 Oct. 28, 2021

(30) Foreign Application Priority Data

Jul. 12, 2018 (RU) ..... RU2018125716

(51) Int. Cl.
*G21F 9/00* (2006.01)
*G21F 9/32* (2006.01)
*G21F 9/02* (2006.01)
*G21F 9/34* (2006.01)
*G21F 9/12* (2006.01)

(52) U.S. Cl.
CPC ..... *G21F 9/32* (2013.01); *G21F 9/02* (2013.01); *G21F 9/34* (2013.01); *G21F 9/12* (2013.01)

(58) Field of Classification Search
CPC ..... G21F 9/00; G21F 9/004; G21F 9/34
USPC ..... 588/15
See application file for complete search history.

(56) References Cited

U.S. PATENT DOCUMENTS

2021/0158985 A1* 5/2021 Sharov ..... G21F 9/34
2021/0257120 A1* 8/2021 Shevchenko ..... G21F 9/30

* cited by examiner

*Primary Examiner* — Edward M Johnson
(74) *Attorney, Agent, or Firm* — J. Miguel Hernandez; James R. Gourley; Carstens, Allen & Gourley, LLP

(57) ABSTRACT

A method for treatment of spent ion-exchange resins for disposal includes feeding a mixture of spent ion-exchange resins to the a loading tank, separating the ion-exchange resins, feeding separated ion-exchange resins into the a drying chamber, vacuum drying the ion-exchange resins and subjecting the resins to additional heat treatment in a high-temperature furnace, and unloading the treated ion-exchange resins into a transport container. A device for treatment of spent ion-exchange resins includes a loading tank, a metering device connected to a drying chamber, an inclined feed screw located between the loading tank and the metering device, a vacuum pump, a heated gas filter, a high-temperature furnace equipped with a vacuum drying and gas purification system, and a feeding device located between the drying chamber and the high-temperature furnace. A docking unit is connected to a lower part of the high-temperature furnace.

15 Claims, 1 Drawing Sheet

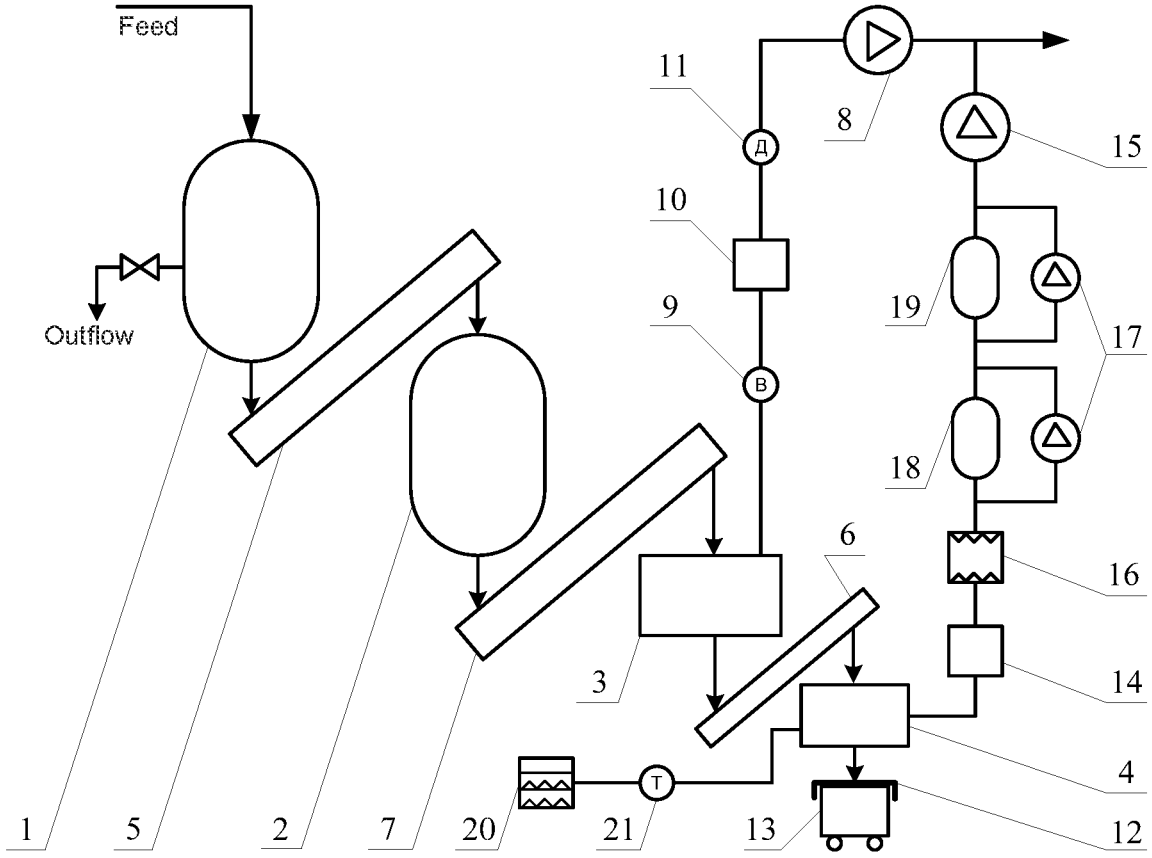
Feed
Outflow
11
8
15
10
9
19
17
18
6
16
3
14
4
1
5
2
7
20
21
13
12

METHOD OF TREATMENT OF SPENT ION-EXCHANGE RESINS FOR DISPOSAL AND DEVICE FOR ITS IMPLEMENTATION

CROSS-REFERENCE TO RELATED APPLICATIONS

This application is a US 371 application from PCT/RU2018/000603 filed Sep. 13, 2018, which claims priority to Russian Application No. 2018125716 filed Jul. 12, 2018, the technical disclosures of which are hereby incorporated herein by reference.

The group of inventions relates to nuclear energy, in particular, to the treatment of spent ion-exchange resins, and can be used at nuclear power plants or special plants.

Ion-exchange resins are widely used at nuclear power plants to ensure the water-chemical mode of the primary and secondary circuits, the post-purification of condensate from evaporation plants and other auxiliary water systems, as well as during decommissioning of nuclear power units. During use, a significant amount of spent, including oily, ion-exchange resins is accumulated, which relate mainly to low- and medium-active liquid waste, which must be treated for their subsequent storage.

A known system for the thermal processing of radioactive ion-exchange resin containing a thermoreactor equipped with a heater with loading and unloading units, therein the system contains a water vapor condenser connected by a line to a thermoreactor, a condensate receiver connected by a line to a water vapor condenser, and a vacuum pump, the input of which is connected to a condensate receiver, and its output is connected to the air exhaust line (utility model 121396, IPC G21F 9/28).

The disadvantage of the above method of drying spent ion-exchange resins is the low energy efficiency of the process.

The nearest analogue of the claimed invention is a utility model "System for drying spent ion-exchange resins" according to the patent of the Russian Federation No. 161811, IPC G21F 9/28. The said system includes a loading unit connected to a pipeline for feeding a mixture of spent ion-exchange resins and transport water and a pipeline for draining transport water, a metering device, a thermoreactor connected to it, equipped with stirrers, an inclined screw located between the loading unit and the metering device, and also a unit docking for unloading treated ion-exchange resins. The water vapor generated during drying of ion-exchange resins is removed through an aerosol filter equipped with heating using a liquid-packed ring vacuum pump.

The disadvantage of the closest analogue is the low efficiency of the process and the low bulk factor of the dried ion-exchange resins.

The object solved by this group of inventions is to increase efficiency and expand functionality.

The technical result achieved by the claimed group of inventions consists in microencapsulation of ion-exchange resins (immobilization of radionuclides inside microcapsules), reducing the volume of discharged ion-exchange resins and preventing their swelling when exposed to moisture.

The said technical result relating to the method is achieved due to the fact that in the method for treatment of spent ion-exchange resins for disposal, comprising feeding a mixture of spent ion-exchange resins with transport water to the loading tank, separating the ion-exchange resins from the transport water by settling the mixture and draining the transport water from the loading tank, the subsequent metered feed of ion-exchange resins separated from the transport water into the drying chamber, vacuum drying with simultaneous mixing of the ion-exchange resins in the drying chamber at a temperature not exceeding 90° C. and unloading the treated ion-exchange resin into a transport container, it is proposed that the ion-exchange resins after vacuum drying in the drying chamber are subjected to additional heat treatment in a high-temperature furnace at a temperature of 250-300° C. with simultaneous stirring and vacuum drying, and unloading treated ion-exchange resin in a transport container is carried out after heat treatment in a high temperature furnace.

In addition, it is proposed that the mixture of spent ion-exchange resins with transport water in the loading tank be settled for 10-15 minutes. It is also claimed that ion-exchange resins are fed into the drying chamber in batches of 5 to 10 percent of the volume of the drying chamber; after feeding the first portion, ion-exchange resins are vacuum dried to reach a humidity content of 6-8%, then a new portion is fed and the vacuum drying process is repeated until complete filling the drying chamber. In addition, it is claimed that hot air with a temperature of at least 200° C. be additionally charged into a high temperature furnace. It is proposed to carry out the removal and subsequent purification of the resulting gases and water vapor from a high temperature furnace in the process of heat treatment.

The said technical result regarding the device is achieved due to the fact that the device for treatment of spent ion-exchange resins for disposal, including a loading tank connected to a pipeline for feeding a mixture of spent ion-exchange resins and transport water and a pipeline for draining transport water, a metering device connected to a drying chamber equipped with stirrers, an inclined feed screw located between the loading tank and the metering device, a vacuum pump connected by a pipe to the drying chamber, a heated gas filter installed on the pipeline between the drying chamber and the vacuum pump and the docking unit for discharging the treated ion exchange resins, is claimed to additionally equip with a high-temperature furnace with stirrers, as well as a feeding device located between the drying chamber and the high-temperature furnace, to equip the high-temperature furnace with a vacuum drying and gas purification system, and to connect the docking unit for unloading ion-exchange resins to the lower part of the high-temperature furnace.

In addition, it is proposed that the loading tank be equipped with a transport water level sensor installed in its upper part and an ion-exchange resin level sensor installed below the transport water level sensor at or below the outlet level of the transport water drain pipe, and a metering device be equipped with a resin level sensor installed at the top of it. It is also proposed that the metering device be made in the form of a cylindrical tank. There is proposed a device for treatment of spent ion-exchange resins for disposal to be equipped with an additional feeding device located between the metering device and the drying chamber, and the feeding device and the additional feeding device to be made in the form of an inclined screw. It is also proposed that a high temperature furnace be equipped with an air heater and a temperature controller connected to the high temperature furnace with a pipeline, and an air heater be made in the form of two coaxially arranged cylindrical chambers equipped with electric heaters. The vacuum drying and gas purification system of a high-temperature furnace is proposed to be made of a gas purification filter and an additional vacuum pump connected by a pipeline, acid and alkaline absorbers located between them with circulation pumps and an after-burner, and the gas purification filter and after-burner to be equipped with heating elements. It is proposed to install a vacuum sensor and a humidity sensor on the pipeline between the vacuum pump and the drying chamber. In addition, it is proposed that the docking station be equipped with a bonnet for docking the high temperature furnace and the container lid.

The application of a method in which ion-exchange resins after vacuum drying are thermally treated to a state of microencapsulation, leads to the achievement of the said technical result.

BRIEF DESCRIPTION OF THE DRAWINGS

FIG. 1 illustrates an example of a device for treatment of spent ion-exchange reins for disposal.

DETAILED DESCRIPTION OF THE DRAWINGS

The claimed group of inventions is illustrated in graphic material, where the figure shows a device for treatment of spent ion-exchange resins for disposal.

A device for treatment of spent ion-exchange resins for disposal includes loading tank 1, metering device 2, made in the form of a cylindrical tank, drying chamber 3, connected to metering device 2, equipped with stirrers, and high temperature furnace 4, equipped with stirrers (stirrers are not shown in the figure), connected to drying chamber 3. Loading tank 1 is connected to a pipeline for feeding a mixture of spent ion-exchange resins and transport water and a pipeline for draining the transport water.

Inclined feed screw 5 is located between loading tank 1 and metering device 2, feeding device 6 is located between drying chamber 3 and high-temperature furnace 4, and additional feeding device 7 is located between metering device 2 and drying chamber 3.

Also, loading tank 1 is equipped with a transport water level sensor installed in its upper part and an ion-exchange resin level sensor installed below the transport water level sensor at or below the outlet level of the transport water drain pipe, and metering device 2 is equipped with a resin level sensor installed at the top of it (sensors are not indicated in the figure). Vacuum pump 8 is connected to drying chamber 3 by a pipe on which humidity sensor 9, heated gas filter 10 and vacuum sensor 11 are installed in succession.

The lower part of high temperature furnace 4 is connected to docking unit 12 for unloading the treated ion-exchange resins into container 13. High temperature furnace 4 and docking unit 12 are connected by pipelines to a vacuum drying and gas purification system. The vacuum drying and gas purification system includes gas purification filter 14 and additional vacuum pump 15, connected between them after-burner 16, and alkaline absorber 18 and acid absorber 19 equipped with circulation pumps 17. Alkaline absorber 18 is designed to neutralize the acid components of the exhaust gas, and acid absorber 19 is designed to further purify the gas after alkaline absorber 18. Circulation pumps 17 are designed for continuous irrigation with a solution of cartridges in absorbers 18 and 19. Gas purification filter 14 and after-burner 16 are equipped with heating elements. High temperature furnace 4 is also equipped with pipeline-connected air heater 20 and temperature controller 21, for example a resistance thermal converter. Air heater 20 is made in the form of two coaxially arranged cylindrical chambers, each of which is equipped with an electric heater. Feeding device 6 and additional feeding device 7 are made in the form of an inclined screw.

Docking unit 12 comprises a bonnet (not shown in the figure) for docking high temperature furnace 4 and the lid of container 13. The bonnet provides a complete overlap of the holes in the lid of container 13 and eliminates the possibility of discharge of gases and aerosols generated when it is filled.

The operation of the device and the method of treatment of spent ion-exchange resins for disposal is as follows.

A mixture of spent ion-exchange resins with transport water is fed into loading tank 1 until the sensor of the level of transport water installed in its upper part is triggered. After that, the ion-exchange resins are separated from the transport water in loading tank 1 by settling the mixture for 10-15 minutes, then the transport water is drained and the mixture of spent ion-exchange resins with transport water is re-fed into loading tank 1. The said operation is repeated until the ion-exchange resin level sensor is triggered. After triggering the ion-exchange resin level sensor, transport water is drained and ion-exchange resins are fed into metering device 2 using inclined feed screw 5, until the resin level sensor is triggered. The ion-exchange resins with a humidity content of 50-60% are fed from metering device 2 to drying chamber 3 using additional feeding device 7, it is metered in portions in the amount of 5-10 percent of the volume of drying chamber 3. After feeding the first portion of the ion-exchange resins, vacuuming up to 8 kPa is carried out using vacuum pump 8 and further vacuum drying at a temperature of not more than 90° C. with simultaneous stirring until the ion-exchange resins reach a humidity content of 6-8%. Then, vacuum pump 8 is turned off, after equalizing the pressure with the atmospheric pressure in drying chamber 3, a new portion of ion-exchange resins is fed and the vacuum drying process is repeated until drying chamber 3 is completely filled. In the process of vacuum drying the ion-exchange resins in drying chamber 3, water vapor is purified in heated gas filter 10. Drying chamber 3 is evacuated to increase the drying efficiency of ion-exchange resins, as well as to intensify the drying process with the removal of not only surface but also pore free moisture. The humidity level control in drying chamber 3 is carried out according to the readings of humidity sensor 9, and the vacuum level is controlled according to the readings of vacuum sensor 11. The dried ion-exchange resin is fed from drying chamber 3 by means of feeding device 6 to high temperature furnace 4, in which the ion-exchange resins are heat-treated at a temperature of 250-300° C. with simultaneous stirring and vacuum drying for a period of 200 to 350 minutes, while the ion-exchange resins go into a state of microencapsulation. At the same time, hot air with a temperature of at least 200° C. is charged into the high temperature furnace using air heater 20 in order to prevent thermal damage to high temperature furnace 4 due to the temperature difference between high temperature furnace 4 and air. The temperature of the fed hot air is controlled by temperature controller 21. After heat treatment, the microencapsulated ion-exchange resins are unloaded via docking unit 12 into container 13. Water vapor and gases released during the heat treatment and unloading of ion-exchange resins into container 13 are removed using additional vacuum pump 15, therein the gases are purified of aerosols by gas purification filter 14 and oxidized to higher oxides in after-burner 16, after which they are further purified on absorbers 18 and 19.

The claimed group of inventions allows to reduce the volume of unloaded ion-exchange resins by more than 2 times, ensuring their swelling no more than 10% (by translating them into a state of microencapsulation) and preventing the immobilization of radionuclides inside microcapsules.

The invention claimed is:

1. A method for treatment of spent ion-exchange resins for disposal, the method comprising:

feeding a mixture of spent ion-exchange resins with transport water to a loading tank;

separating the spent ion-exchange resins from the transport water by settling the mixture and draining the transport water from the loading tank;

metered feeding of the spent ion-exchange resins separated from the transport water into a drying chamber, and vacuum drying with simultaneous mixing of the spent ion-exchange resins in the drying chamber at a temperature not exceeding 90° C. to provide dried ion-exchange resins;

subjecting the dried ion-exchange resins to additional heat treatment in a high-temperature furnace at a temperature of 250-300° C. with simultaneous stirring and vacuum drying to provide treated ion-exchange resins, and unloading the treated ion-exchange resins into a transport container.

2. The method for treatment of spent ion-exchange resins for disposal according to claim 1, wherein the mixture of spent ion-exchange resins with transport water in the loading tank is settled for 10-15 minutes.

3. The method for treatment of spent ion-exchange resins for disposal according to claim 1, wherein the metered feeding and vacuum drying of the spent ion-exchange resins comprises: feeding the ion-exchange resins are fed into the drying chamber in a plurality of batches of 5 to 10 percent of the volume of the drying chamber; and after feeding a first batch of the plurality of batches, ion-exchange resins are vacuum dried to reach a humidity content of 6-8%, then a subsequent batch is fed into the drying chamber and the vacuum drying process is repeated until completely filling the drying chamber.

4. The method for treatment of spent ion-exchange resins for disposal according to claim 1, wherein hot air with a temperature of at least 200° C. is additionally charged into the high-temperature furnace.

5. The method for treatment of spent ion-exchange resins for disposal according to claim 1, wherein removal and subsequent purification of the resulting gases and water vapour from the high-temperature furnace is carried out during a process of the additional heat treatment.

6. A device for treatment of spent ion-exchange resins for disposal, the device comprising:

a loading tank connected to a pipeline for feeding a mixture of spent ion-exchange resins and transport water and a pipeline for draining transport water;

a drying chamber equipped with stirrers;

a metering device connected to the drying chamber equipped with stirrers;

an inclined feed screw located between the loading tank and the metering device;

a vacuum pump connected by a pipeline to the drying chamber;

a heated gas filter installed on the pipeline between the drying chamber and the vacuum pump;

a docking unit for discharging the treated ion exchange resins;

a high-temperature furnace with stirrers; and a feeding device located between the drying chamber and the high-temperature furnace, the high-temperature furnace being equipped with a vacuum drying and gas purification system, and the docking unit for discharging the treated ion-exchange resins being connected to a lower part of the high-temperature furnace.

7. The device for treatment of spent ion-exchange resins for disposal according to claim 6, wherein the loading tank is equipped with a transport water level sensor installed in its an upper part of the loading tank and an ion-exchange resin level sensor installed below the transport water level sensor at or below an outlet level of the pipeline for draining the transport water, and the metering device is equipped with a resin level sensor installed at a top of the metering device.

8. The device for treatment of spent ion-exchange resins for disposal according to claim 6, wherein the metering device is made in the shape of a cylindrical tank.

9. The device for treatment of spent ion-exchange resins for disposal according to claim 6, wherein the device is equipped with an additional feeding device located between the metering device and the drying chamber.

10. The device for treatment of spent ion-exchange resins for disposal according to claim 9, wherein the feeding device and the additional feeding device are made in the shape of a inclined screw.

11. The device for treatment of spent ion-exchange resins for disposal according to claim 6, wherein the high-temperature furnace is equipped with an air heater and a temperature controller; and the air heater and the temperature controller are connected to the high temperature furnace with a pipeline; and the air heater is made in the form of two coaxially arranged cylindrical chambers equipped with electric heaters.

12. The device for treatment of spent ion-exchange resins for disposal according to claim 6, wherein the vacuum drying and gas purification system of the high temperature furnace comprises: (i) a gas purification filter; (ii) an additional vacuum pump connected to the gas purification filter by a pipeline, and, connected between the gas purification filter and the additional vacuum pump, (iii) an alkaline absorber equipped with a circulation pump, (iv) an acid absorber equipped with a circulation pump and (v) an after-burner.

13. The device for treatment of spent ion-exchange resins for disposal according to claim 12, wherein the gas purification filter and after-burner are equipped with heating elements.

14. The device for treatment of spent ion-exchange resins for disposal according to claim 6, wherein a vacuum sensor and a humidity sensor are installed on the pipeline between the drying chamber and the vacuum pump.

15. The device for treatment of spent ion-exchange resins for disposal according to claim 6, wherein the docking unit is equipped with an umbrella for docking the high-temperature furnace and a container lid.

* * * * *